United States Patent [19]

Neal

[11] 4,408,429

[45] Oct. 11, 1983

[54] PLUG FOR HOLES IN WALLS

[76] Inventor: Larry V. Neal, 1352 Burnside Ave., Apt. 6, Los Angeles, Calif. 90019

[21] Appl. No.: 310,434

[22] Filed: Oct. 13, 1981

[51] Int. Cl.[3] ..... E04G 23/02

[52] U.S. Cl. ..... 52/514

[58] Field of Search ..... 52/514; 292/62

[56] References Cited

U.S. PATENT DOCUMENTS

| | | | |
|---|---|---|---|
| 3,690,084 | 9/1972 | Leblanc | 52/514 |
| 3,834,107 | 9/1974 | Standing | 52/514 |
| 3,999,347 | 12/1976 | Devlin | 52/514 |
| 4,207,655 | 6/1980 | MacMaster | 292/62 X |

*Primary Examiner*—Kenneth Downey

*Attorney, Agent, or Firm*—Ralph B. Pastoriza

[57] ABSTRACT

A plug is used in repairing holes in walls made up of first and second dry wall panels on opposite sides of vertical studs. The plug itself comprises a first body member slidable along a shaft to which a second body member is held on one end. A spring normally biases the body members apart but they can be compressed to a compact configuration for easy insertion in an appropriate cut-out surrounding the hole to be repaired. After the plug bodies have been inserted, the one body is released from its locked position so that the spring will expand the bodies apart. The first body will eclipse the inside of the cut-out in the wall panel to be repaired while the second body seats against the rear surface of the second wall panel to hold the first body in place. Finishing plaster can then cover the front surface of the first body to complete the patching.

4 Claims, 5 Drawing Figures

PLUG FOR HOLES IN WALLS

FIELD OF THE INVENTION

This invention relates generally to the patching of holes in walls and more particularly to an improved plug for aiding in repairing holes in walls of the type made up of first and second dry wall panels on opposite sides of vertical studs.

BACKGROUND OF THE INVENTION

Many residences as well as commercial dwellings utilize dry wall panels; that is, pre-formed 4 ft.×8 ft. sheets of gypsum board or the like. Normally, first and second such wall panels are secured on opposite sides of the normal 2×4 vertical studs to form the wall.

Often one of the wall panels will be damaged such as by a door knob on a swinging door in a corner portion of a room when the door is repeatedly opened and the normal door stop has not functioned properly. The damage takes the form of an actual hole punctured through the wall panel.

It is very difficult to repair such a hole by plaster since there is no support for the plaster and if the hole is relatively large, the patching can become quite awkward. A screen mesh can be secured over the opening to support the plaster, but then the finished front surface is no coplanar with the rest of the wall. Such a mesh could be applied to the rear of the hole by bending the mesh and then unbending the same and attempting to secure it with tacks or the like to the rear marginal edge. Again, however, such a mesh is not very strong and any plaster applied thereto could easily be punched out.

Because of the foregoing problems, either the entire panel has to be replaced or some type of rigid backing must be provided over the inside of the hole so that the final finishing plaster can be properly supported. With the latter thought in mind, a number of different types of plug arrangements have been proposed in the prior art to provide some type of backing to a hole to permit the same to be repaired. While such plugs can be effective, the ones available in the prior art are fairly complicated in construction and are time-consuming to install. For example, many of them incorporate screw means for urging first and second body members apart after they have been positioned through the opening in a collapsed position. A first one of the body members by threading the screw will then be backed against the rear marginal portions of the opening and the second body member will seat against a backing or the inside of the second wall panel to stabilize the structure.

Other proposed solutions simply employ a biasing spring between two members to urge them apart after they have been inserted in a collapsed position between the dry wall panels. These latter devices, while simple to install, do not really provide a rigid backing since any pressure applied to the exposed front portion of the first body at the hole will simply compress the spring and possibly dislodge the entire plug.

BRIEF DESCRIPTION OF THE PRESENT INVENTION

With the foregoing considerations in mind, the present invention contemplates an improved plug for holes in walls particularly useful in repairing a hole in the first panel of a wall construction comprised of first and second wall panels on opposite sides of vertical studs wherein the plug can be very quickly installed and yet will provide a rigid backing. Moreover, the construction is such that the component parts can be produced relatively economically.

More particularly the plug includes a first body member having a central opening. A shaft has one end receivable in this opening and serves to support a second body member on its other end. Means provided for biasing the second body away from the first body so that the bodies can be introduced into a cut-out surrounding a hole to be plugged in a wall panel in a compact position with the bodies relatively close together. The bodies are then released to expand with the first body covering a substantial area of the rear of the cut-out and the second body engaging a backing, such as the second wall panel behind the first wall panel so that the first body is held in place. The structure is designed such that it can be positively locked in its set position so that forces exerted on the first member after so being set will not collapse the spring and thus result in possible dislodgement of the plug.

BRIEF DESCRIPTION OF THE DRAWINGS

A better understanding of this invention will be had by now referring to the accompanying drawings in which.

DETAILED DESCRIPTION OF THE PREFERRED EMBODIMENT

Figure 1:
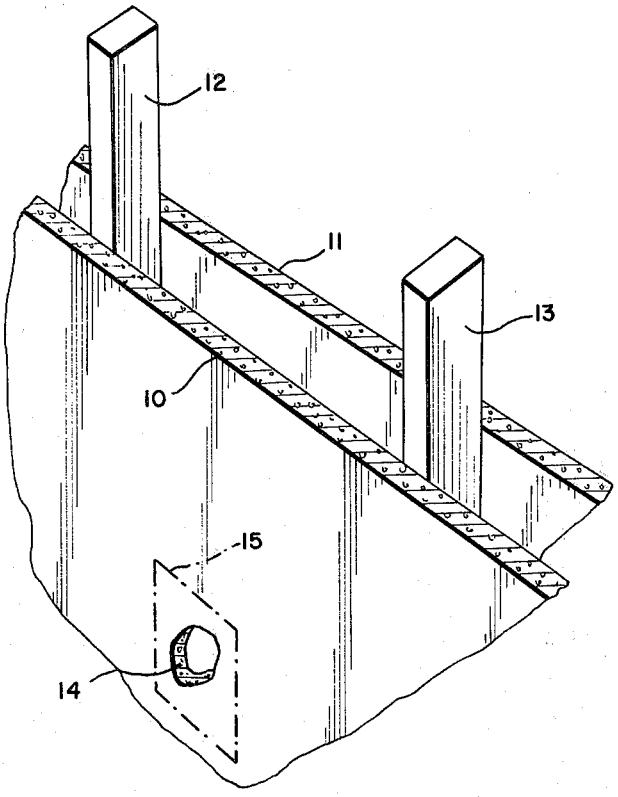
FIG. 1 is a fragmentary perspective view of a wall having a hole to be repaired with the plug of the present invention.

Referring first to FIG. 1 there is shown a wall structure made up of first and second wall panels 10 and 11 on opposite sides of vertical studs 12 and 13. Each of the wall panels 10 and 11 may comprise gypsum board sheets normally provided in 4 ft.×8 ft. sizes.

As shown for the first wall panel 10, there is a hole 14 constituting damage to the wall. Such holes are often made by door knobs on doors that swing against the wall when opened. As mentioned earlier herein, it is very difficult to patch such holes because plaster and the like will simply fall through between the wall panels, particularly if the hole is relatively large. Thus, it has often been necessary to replace the entire panel.

In accord with the present invention, the hole 14 may readily be patched or repaired by untilizing a plug structure to be described with respect to FIGS. 2 through 5. Initially, however, there is made a cut-out indicated by the dashed lines 15 of rectangular shape about the hole 14. The purpose for providing this rectangular cut-out will become evident as the description proceeds.

Figure 2:
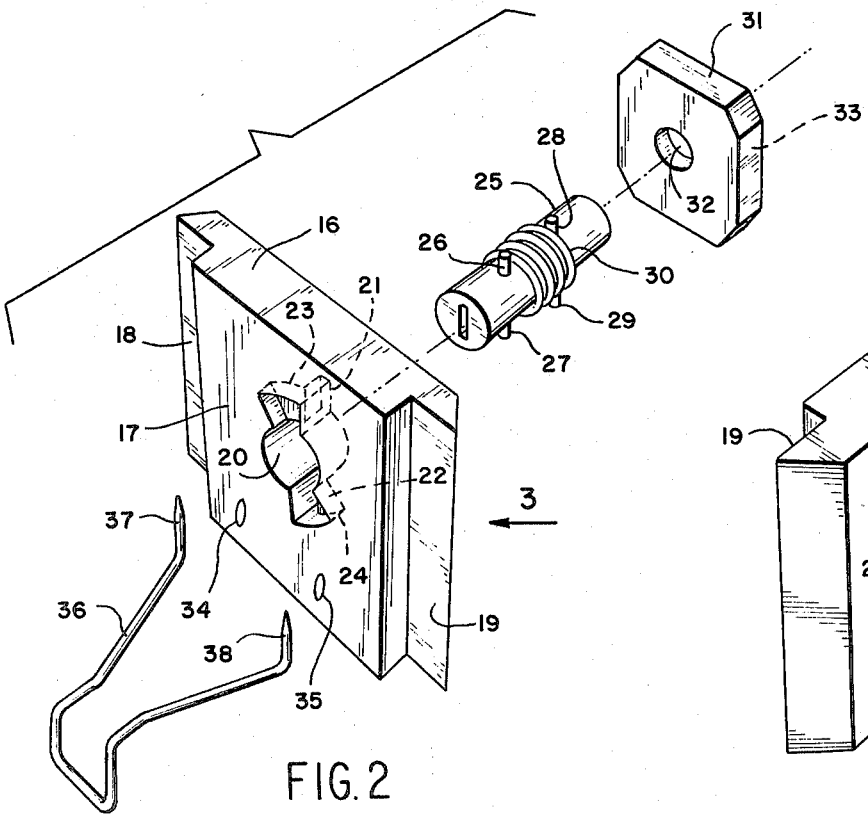
FIG. 2 is an enlarged exploded perspective view of the basic components making up the plug for repairing the hole in the wall of FIG. 1.

Referring now to FIG. 2, there is illustrated the plug structure itself of this invention. Essentially, this plug comprises a first body 16 having a flat front surface 17 with stepped sides 18 and 19 for engaging opposite inside marginal edges of the cut-out 15 in the wall panel 10 of FIG. 1 when using the plug, all as will become clearer as the description proceeds.

The body 16 further includes a central opening 20 with upper and lower slots 21 and 22 at its rear exit end and arcuate cut-outs extending partially into its front entrance end communicating with the slots to define diametrically opposite internal ledges 23 and 24.

Cooperating with the first body 16 and central opening 20 is a shaft 25 having a first pair of diametrically oppositely extending pins 26 and 27 at a given spacing from one end such that this one end and the pins can be received in the central opening and slots from the rear to protrude out the front of the first body 16 and rotated to seat the first pair of pins 26 and 27 on the internal ledges 23 and 24.

Shaft 25 also includes a second pair of diametrically oppositely extending pins 28 and 29 which serve as a stop means at a given spacing from the far end of the pin.

The foregoing described stop means in the form of the second pins 28 and 29 serve as a stop for one end of a compression spring 30 surrounding the shaft 25 between the first and second pairs of pins. The arrangement is such, however, that after the first pair of pins 26 and 27 are received in the slots 21 and 22 the front end of the spring will bear against the rear periphery of the central opening 20 and will become compressed as the one near end of the shaft is received in the opening 20 and protrudes from the other side. The spring 30 thus exerts a biasing force on the shaft 25 tending to urge the shaft out of the central opening 20. However, when the first pair of pins 26 and 27 are seated on the ledges 23 and 24, the shaft is held against this biasing force in the opening 20.

The principal components of the plug are completed by the provision of a second body 31 having a front central circular cavity 32 for receiving the other or far end of the shaft 25. The second body 31 has a flat rear surface 33 which is in a spaced position juxtaposed to the inside surface of the second wall panel 11 of FIG. 1 when the first body is in the cut-out 15 of the first wall panel 10 and the pins are seated on the ledges of the first body.

Stil referring to FIG. 2, the front surface 17 of the first body 16 includes small angulated openings 34 and 35 for cooperation with a wire handle 36 having ends 37 and 38 receivable in these openings. The wire handle 36 serves as a holding means facilitating manipulation of the entire assembled plug when inserting the same between the wall panels 10 and 11 through the cut-out 15.

Figure 3:
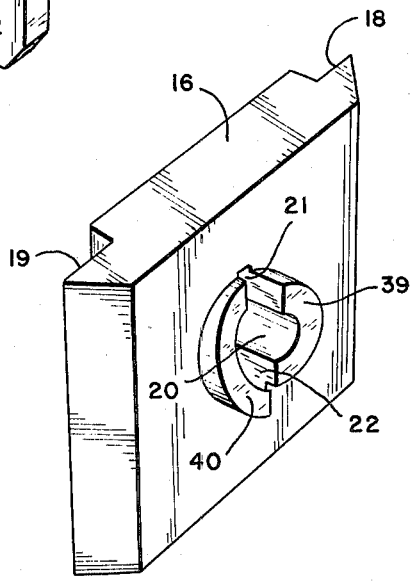
FIG. 3 is a rear perspective view of one of the plug components looking in the direction of the arrow 3 of FIG. 2.

A further important feature of the present invention is illustrated in FIG. 3 in the form of a pair of inclined planes 39 and 40 extending circumferentially about the opening 20 to define cam surfaces for the pins 26 and 27, all as will become clearer as the description proceeds.

Figure 4:
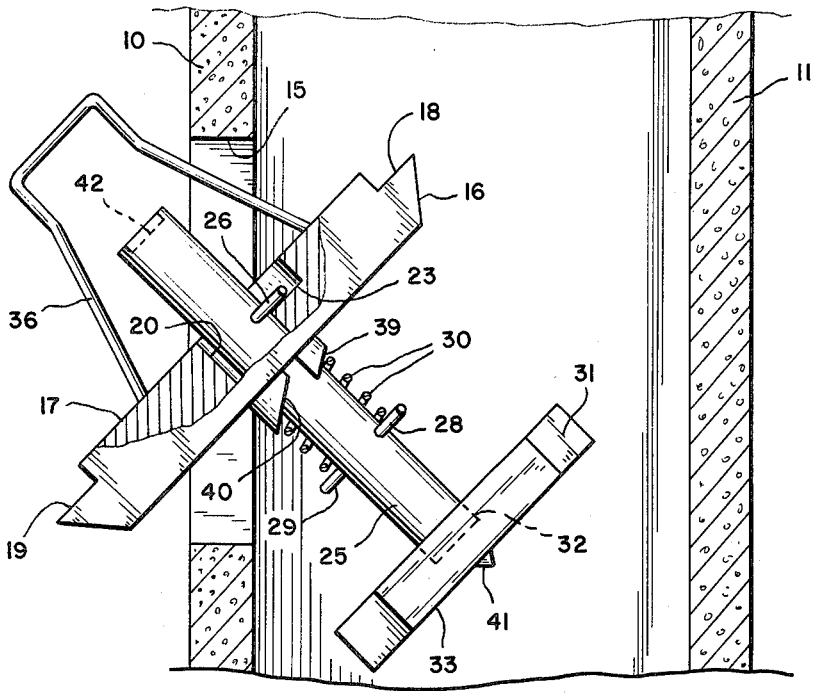
FIG. 4 is a top plan view partly in cross section of the wall panels of FIG. 1 showing an initial step in utilizing the plug structure of FIG. 2 for closing a hole in the wall.

Referring now to FIG. 4, the various components of the plug described in FIG. 2 are shown in assembled relationship wherein it will be noted that the shaft 25 has been received through the opening 20 in the body member 16 with the pin 26 seated on the ledge 23, to hold the shaft 25 in this position. In this respect, it will be understood that the shaft is first oriented so that the pin 26 is received in the slot 21 described in FIG. 2 and shown in the rear view of FIG. 3. The shaft 25 is then rotated to seat the pin 26 on the ledge 23 in a bayonet-like action.

The spring 30 is compressed by the second pair of pins 28 and 29 on the shaft 25, constituting the stop means for the spring. The spring itself is shown bearing against the cam surfaces 39 and 40 at the periphery of the rear opening 20 described in FIG. 3.

Essentially, the first and second bodies 16 and 31 are held in a compressed state relatively close together.

The wire handle 36 is shown secured to the front face of the body member 16 in FIG. 4 to permit easy manipulation of the assembled plug structure. It will be noted that the plug structure has been tilted in order that the first body 16 can be received through the cut-out 15. In this respect, it will be appreciated that the body 16 is also of rectangular shape. The one dimension of the cut-out 15, however, is made less than the dimension of the body 16 between the outer edges of the stepped sides 18 and 19 so that these stepped sides can engage the marginal portions of the cut-out 15.

Figure 5:
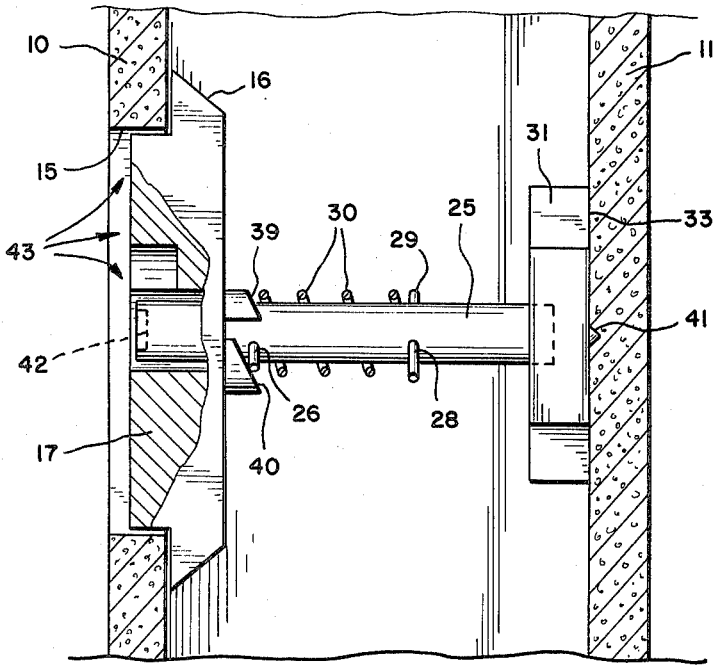
FIG. 5 is a view similar to FIG. 4 but showing the plug in its final position.

The above engagement is illustrated more clearly in FIG. 5 wherein the body 16 is in a position to cover substantially the complete area of the cut-out 15.

In FIG. 5 the shaft 25 has been rotated to unseat the first diametrically opposite pins 26 and 27 from the corresponding ledges such as 23 and 24 so that the spring 30 can now urge the shaft 25 out from the rear of the first body 16 towards the second wall panel 11. The rear surface 33 of the second body 31 will thus engage the second wall panel 11 as shown.

The spacing between the first and second wall panels 10 and 11 is standard in the industry and the length of the shaft 25 and positioning of the first diametrically oppositely extending pins 26 and 27 described in FIG. 2 is such that when the bodies are in the expanded position illustrated in FIG. 5, a further rotation of the shaft 25 will bring the pins 26 and 27 into a crosswise position relative to the slots in the rear opening thereby locking the first and second bodies in their expanded positions.

With respect to the foregoing, by providing the inclined planes or cam surfaces 39 and 40, the further rotation of the shaft 25 will cause the pins 26 and 27 to ride up on the surfaces respectively as shown best with the pin 26 on the cam surface 40 thereby camming the shaft 25 and second body 31 tightly against the second wall panel 11.

The sloping surfaces of the cams 39 and 40 have been greatly exaggerated in FIG. 5 for purposes of clarity. It will be understood that the slope is just sufficient to provide for a slightly additional movement to effect the right engagement of the second body 31 with the rear wall 11 and to make sure that the first body 16 is pressed firmly against the cut-out 15.

In FIGS. 4 and 5 it will be noted that the rear surface 33 of the second member 31 may have a small point 41 formed for initial engagement with the second wall panel 11. This point will aid is frictionally retaining the second member 31 against the wall surface 11.

Also, to aid in rotating the shaft 25 when locking the members in place, the one end portion shown at the left end in FIGS. 4 and 5 of the shaft 25 may be provided with a turning slot 42 so that a screwdriver or coin can be used to readily rotate the shaft 25 to release the pins from the ledges and also to cam the pins on the cam surfaces to effect the final tightening of the structure.

It will be noted in FIG. 5 that in the final position, there is left some slight space between the front surface 17 of the body member 16 and the front plane of the wall 10 itself. This area is filled in with appropriate plaster schematically indicated by the arrows 43 to provide a finish which is absolutely flush with the front surface of the wall 10. The first body 16 forming the plug portion within the cut-out 15 will, of course, serve as a strong backing for this final plastering operation.

It will be further understood that the wire holder 36 described in FIG. 4 is simply removed from the angulated openings in the front surface 17 of the member 16 after the plug has been inserted prior to the described plastering operation.

From all of the foregoing, it can now be appreciated that the present invention has provided a greatly improved plug for holes in walls. The components are relatively inexpensive to manufacture and can be easily and quickly assembled and installed. No special tools are required other than a screwdriver or coin to rotate the shaft 25.

While the invention has been described with respect to plugging one hole in a dry wall panel, it should be understood that should the hole extend through both panels such as the panels 10 and 11, the second body 31 of the device can be used to plug such additional hole. In this respect, the second body would be made larger if necessary; for example, similar in size and shape to the first body member 16.

Various other changes falling within the scope and spirit of this invention will occur to those skilled in the art. The plug structure accordingly is not to be thought of as limited to the exact construction set forth merely for illustrative purposes.

I claim:

1. A plug for holes in walls made up of first and second wall panels on opposite sides of vertical studs including, in combination:

(a) a first body having a flat front surface with opposite stepped sides for engaging opposite inside marginal edges of a cut-out about a hole in the first wall panel so that the first body extends within the cut-out, said first body further having a central opening with upper and lower slots at its rear exit end and arcuate cut-outs extending partially into its front entrance end communicating with said slots and defining diametrically opposite internal ledges;

(b) a shaft having a first pair of diametrically oppositely extending pins at a given spacing from one end such that said one end and pins can be received in said central opening and slots from the rear to protrude out the front of said first body and rotated to seat said first pair of pins on said internal ledges said shaft having a second pair of diametrically oppositely extending pins at a given spacing from its other end;

(c) a compression spring surrounding said shaft between the first and second pairs of pins such that when the first pair of pins enters the slots, the spring bears against the rear periphery of the central opening and is compressed as the one end of the shaft is received in the opening, the spring thereby exerting a biasing force on the shaft tending to urge the shaft out of the central opening, the first pair of pins when seated on the ledges holding the shaft in the opening; and (d) a second body having a front central circular cavity receiving said other end of said shaft and a flat rear surface in a spaced position juxtaposed the inside surface of the second wall panel when said first body is in said cut-out of the first wall panel and the pins seated on the ledges whereby rotation of the protruding one end of the shaft to unseat the pins results in the spring urging the shaft toward the second wall panel to seat the second member against the second wall and thereby hold the first member in place so that the cut-out is plugged, further rotation of the shaft positioning the first pins cross-wise of the slots to lock the relative positions of the first and second bodies in place.

2. A plug according to claim 1, in which the front surface of said first body includes small angulated openings; and a wire handle having ends receivable in said openings to provide means for holding and manipulating the plug when inserting the same through said cut-out.

3. A plug according to claim 1, in which the rear periphery of said central opening includes a pair of inclined planes extending circumferentially about the opening to define cam surfaces for said pins so that said further rotation of said shaft urges the shaft towards the second wall panel to more tightly seat said second body thereagainst.

4. A plug body according to claim 1, in which said first body is rectangular in shape and said cut-out is also rectangular with one dimension shorter than the dimension of said first body between the outside edges of said stepped sides such that the first body member can be inserted by tilting the same and when straightened out to a position parallel to said first wall panel will have its stepped sides seated against the corresponding sides of said rectangular cut-out.

* * * * *